US009132340B2

(12) United States Patent
Fish

(10) Patent No.: US 9,132,340 B2
(45) Date of Patent: Sep. 15, 2015

(54) TOY FIGURE, BOARD GAME INVOLVING THE USE OF A TOY FIGURE, AND METHOD OF PLAYING A BOARD GAME INVOLVING THE USE OF A TOY FIGURE

(71) Applicant: KMA Concepts Limited, Tsim Sha Tsui, Kowloon (HK)

(72) Inventor: Peter Alan Fish, Killara (AU)

(73) Assignee: KMA Concepts Limited, Tsim Sha Tsui, Kowloon (HK)

( * ) Notice: Subject to any disclaimer, the term of this patent is extended or adjusted under 35 U.S.C. 154(b) by 0 days.

(21) Appl. No.: 13/722,611

(22) Filed: Dec. 20, 2012

(65) Prior Publication Data

US 2013/0154189 A1 Jun. 20, 2013

(51) Int. Cl.
*A63F 3/00* (2006.01)
*A63F 11/00* (2006.01)

(52) U.S. Cl.
CPC ..... *A63F 3/00* (2013.01); *A63F 2003/0063* (2013.01); *A63F 2011/0016* (2013.01); *A63F 2250/186* (2013.01)

(58) Field of Classification Search
CPC ..... A63F 2003/0063; A63F 2011/0016; A63F 2250/186; A63H 3/04; A63H 3/46
USPC ..... 273/255, 281, 282, 289, 239; 446/99, 446/100, 101, 129, 308, 309, 312, 97
See application file for complete search history.

(56) References Cited

U.S. PATENT DOCUMENTS

| | | | | |
|---|---|---|---|---|
| 2,399,041 | A * | 4/1946 | Kleber | 273/239 |
| 4,018,445 | A * | 4/1977 | Anania, Sr. | 273/239 |
| 4,371,168 | A * | 2/1983 | Dupuis | 273/239 |
| 2003/0166374 | A1* | 9/2003 | Nelson et al. | 446/379 |
| 2007/0216095 | A1* | 9/2007 | Jacobs | 273/288 |
| 2009/0230622 | A1* | 9/2009 | Wu | 273/238 |
| 2014/0199912 | A1* | 7/2014 | Fish | 446/383 |

* cited by examiner

*Primary Examiner* — Vishu Mendiratta
(74) *Attorney, Agent, or Firm* — LaMorte & Associates, P.C.

(57) ABSTRACT

A toy figure including one or more appendages each made of a coil spring and a magnet disposed at an end portion of each of the one or more appendages. A plurality of such toy figures may be used in a board game that requires players to position a respective one of the toy figures relative to a game board.

5 Claims, 7 Drawing Sheets

TOY FIGURE, BOARD GAME INVOLVING THE USE OF A TOY FIGURE, AND METHOD OF PLAYING A BOARD GAME INVOLVING THE USE OF A TOY FIGURE

FIELD OF THE INVENTION

The present invention is directed to a board game, and in particular to a board game that involves the use of toy figures.

SUMMARY OF THE INVENTION

A toy figure according to an exemplary embodiment of the present invention comprises: one or more appendages each made of a coil spring; and a magnet disposed at an end portion of each of the one or more appendages.

In at least one exemplary embodiment, the toy figure further comprises one or more connectors, each of the one or more connectors comprising an opening for receiving the end portions of the one or more appendages.

In at least one exemplary embodiment, the one or more appendages comprise a plurality of appendages, and at least one of the one or more connectors comprises a plurality of openings for receiving the end portions of the plurality of appendages.

In at least one exemplary embodiment, at least one connector is a Y-shaped connector.

In at least one exemplary embodiment, the at least one connector is a T-shaped connector.

In at least one exemplary embodiment, the at least one connector is a cross-shaped connector.

In at least one exemplary embodiment, the one or more appendages comprise a plurality of appendages so that the end portion of each appendage may be connected to one another by the magnets disposed at the end portion of each appendage.

In at least one exemplary embodiment, the one or more appendages are made of plastic.

A board game according to an exemplary embodiment of the present invention comprises: one or more toy figures, each of the one or more toy figures comprising: one or more appendages each made of a coil spring; and a magnet disposed at an end portion of each of the one or more appendages; and a game board adapted to magnetically attract the magnets disposed at the end portions of each of the one or more appendages of each of the one or more toy figures so as to allow for positioning of the one or more appendages of each of the one or more toy figures relative to the game board.

In at least one exemplary embodiment, the game board comprises: a metal base; a primary game board attached to the metal base in an elevated position, the primary game board comprising a plurality of openings; and side edges extending vertically from the metal base, wherein the magnets disposed at the end portions of each of the one or more appendages of each of the one or more toy figures are magnetically attracted to the metal base through the one or more openings in the primary game board and to the side edges.

In at least one exemplary embodiment, the primary game board comprises a plurality of locations that are colored differently from one another, and each opening in the primary game board is associated with a corresponding one of the locations.

In at least one exemplary embodiment, the board game further comprises a spinner that determines how the one or more appendages of each of the one or more toy figures are to be positioned relative to the game board.

A method of playing a game according to an exemplary embodiment of the present invention comprises: providing a board game comprising: one or more toy figures, each of the one or more toy figures comprising: one or more appendages each made of a coil spring; and a magnet disposed at an end portion of each of the one or more appendages; a game board adapted to magnetically attract the magnets disposed at the end portions of each of the one or more appendages of each of the one or more toy figures so as to allow for positioning of the one or more appendages of each of the one or more toy figures relative to the game board; and a spinner comprising a spinner arrow that is operable to determine how the one or more appendages of each of the one or more toy figures are to be positioned relative to the game board; spinning the spinner arrow to determine how the one or more appendages of one of the one or more toy figures associated with a player are to be positioned relative to the game board; and positioning the one of the one or more toy figures relative to the game board according to the positioning determined by the spinning step.

BRIEF DESCRIPTION OF THE DRAWINGS

The features and advantages of the present invention will be more fully understood with reference to the following, detailed description of illustrative embodiments of the present invention when taken in conjunction with the accompanying figures, wherein.

DETAILED DESCRIPTION OF PREFERRED EMBODIMENTS

Toy figures with magnets in the form of men or animals are common within the toy industry and many designs and materials have been used to create such toy figures. These toy figures may be mounted on metal surfaces such as refrigerators and, if designed from light materials, can be thrown at metal objects for attachment thereto. Existing flying magnetic figures have been made from plastic rope material and form a fixed shape figure. The magnetic stretch toy figure according to exemplary embodiments of the present invention is made from a coil spring, preferably made of a plastic material, which forms the body parts for the figure. The arms, legs and torso, except for the head, may all be made from a coil spring material. In contrast to previous toy figures, the inventive toy figure exhibits a dual function in play. In particular, the material used is light weight and skeletal in form when in a rest position, but can stretch to more than twice its length without breaking before recoiling back to its original position. Rather than having a fixed shape figure the user can stretch it in all different positions before throwing it or attaching it to a metal surface where it returns to its original skeletal shape. This feature of a flying magnetic toy figure makes for a new play pattern and entertainment.

The toy figure according to exemplary embodiments of the present invention also allows for the magnets at the extremities of the arms and legs to be safely secured. Children have suffered extreme injuries and even death from swallowing multiple magnets which lodge in the intestines. In this regard, various methods and materials have been used to secure the magnets. For example, Australian Innovation Patent No. 2008 101160 is directed to a rope man figure. The disadvantage of using rope to make the figures is that the method of securing rope material to the magnet is not always secure and cost effective. In contrast, the coil spring polypropylene material used in various exemplary embodiments of the present invention is as strong as other plastics and rope but is far easier to join by gluing connectors made of the same material. The connectors at the hands and feet may be glued to the coil after the magnet is inserted into a sealed connector with a plug.

The joining of body parts in prior toy figures involved the use of heat to melt the plastic parts into a fixed position. In exemplary embodiments, the toy figure is far easier to assemble with the inclusion of 'Y', '+' 'U' or "T" shaped connectors that become the female member for the coil spring male member body part that are to be glued together. Alternately the male, female members can be reversed so that the connectors become the male member.

Figure 1:
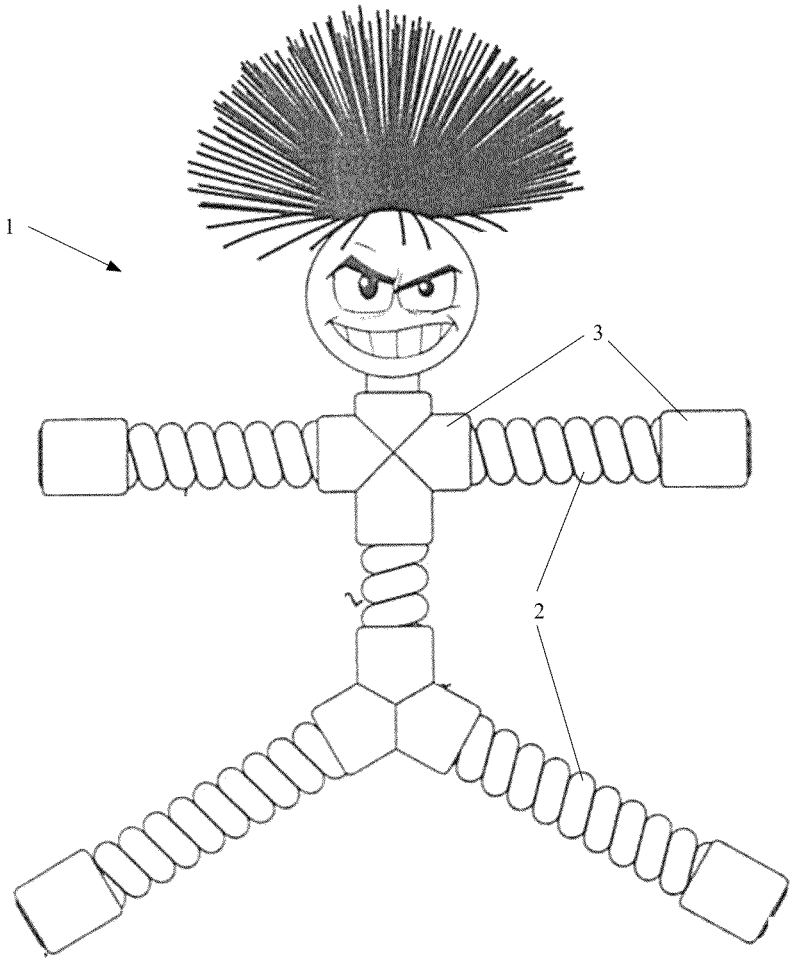
FIG. 1 is a full illustration of a magnetic stretch toy figure according to an exemplary embodiment of the present invention.

FIG. 1 shows a magnetic stretch toy figure, generally designated by reference number 1, according to an exemplary embodiment of the present invention. The magnetic stretch toy 1 is formed in the general shape of a man. However, it should be appreciated that the magnetic stretch toy 1 may be formed into any shape or structure. The magnetic stretch toy 1 includes body parts 2 made of plastic coil springs. Connectors 3 may be used to connect the body parts 2. The connectors 3 may have any suitable shape, such as, for example, a "Y", "T", "U" or "+" shape. In an exemplary embodiment, all of the body parts 2, including the torso, legs and arms, may be made from a plastic coil spring except for the head and connectors 3.

Figure 2:
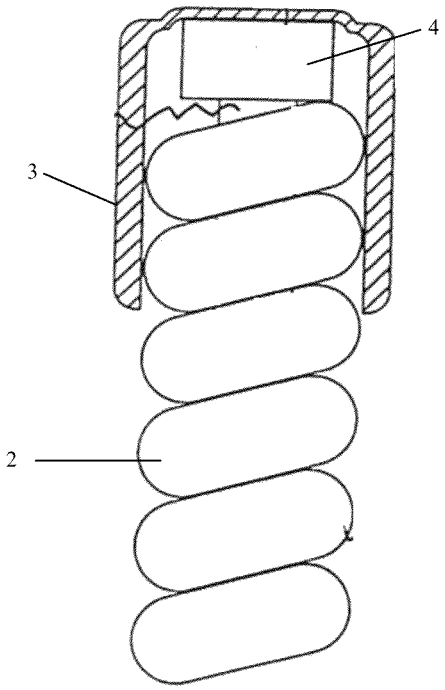
FIG. 2 is a detailed view of a body part of the magnetic stretch toy figure of FIG. 1 according to an exemplary embodiment of the present invention.

As shown in FIG. 2, the body part 2 may be fitted into a "U" shaped connector 3 containing a magnet 4. In this regard, the "U" shaped connector 3 becomes the female member for the body part 2 male member. Before the body part 2 is inserted, a magnet 4 is placed inside the "U" shaped connector 3. The "U" shaped connector 3, magnet 4 and body part 2 may be sealed together with glue or some other adhesive.

Figure 3:
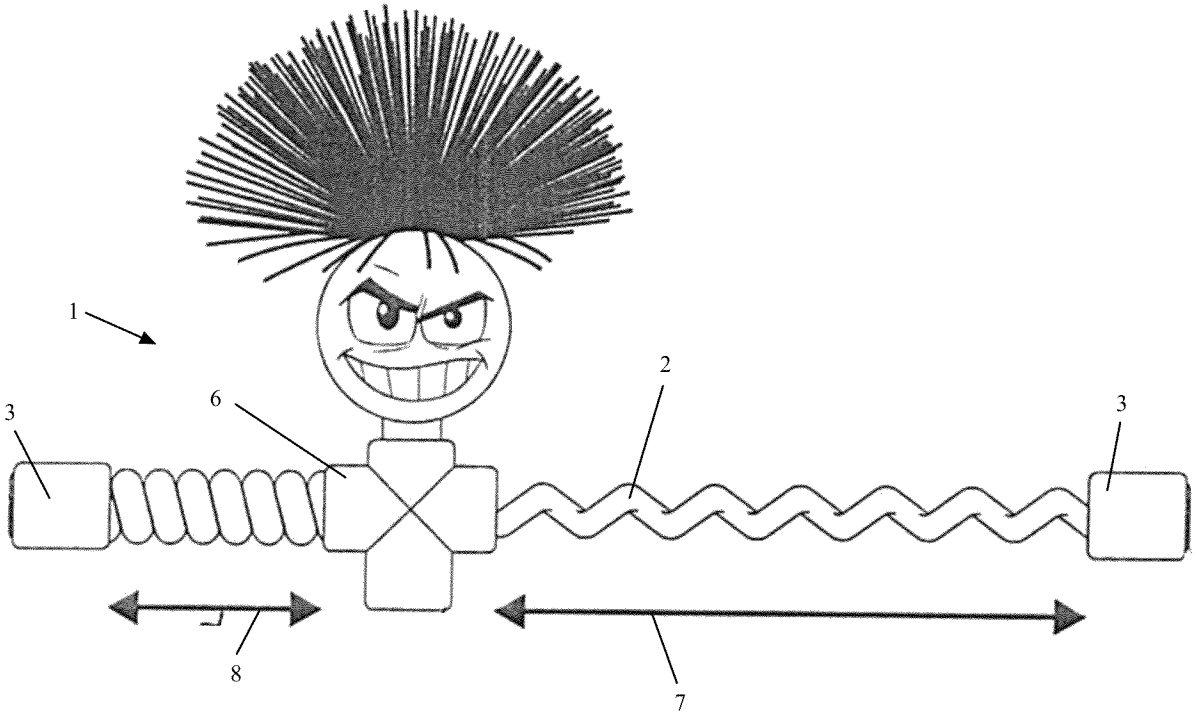
FIG. 3 is an illustration showing the expansion and contraction of body parts of the stretch toy figure of FIG. 1 according to an exemplary embodiment of the present invention.

FIG. 3 shows a multi-point connector 6 that may be used to attach together various parts of the magnetic toy FIG. 1. As with the connectors 3, magnets 4 are disposed within openings of the multi-point connector 6, and adhesive is used to attach the spring body parts 2 to the multi-point connector 6. The body parts 2 as attached to the multi-point connector 6 can now be stretched in any direction. In this regard, stretched arrow line 7 in FIG. 3 illustrates the body part 2 extended to twice its normal skeletal position. Recoiled arrow line 8 of the body part 2 illustrates the recoiled normal position of the skeletal form.

It should be appreciated that any number and variety of connectors may be used to build and extend the play pattern of the magnetic toy figures according to exemplary embodiments of the present invention.

Figure 4A:
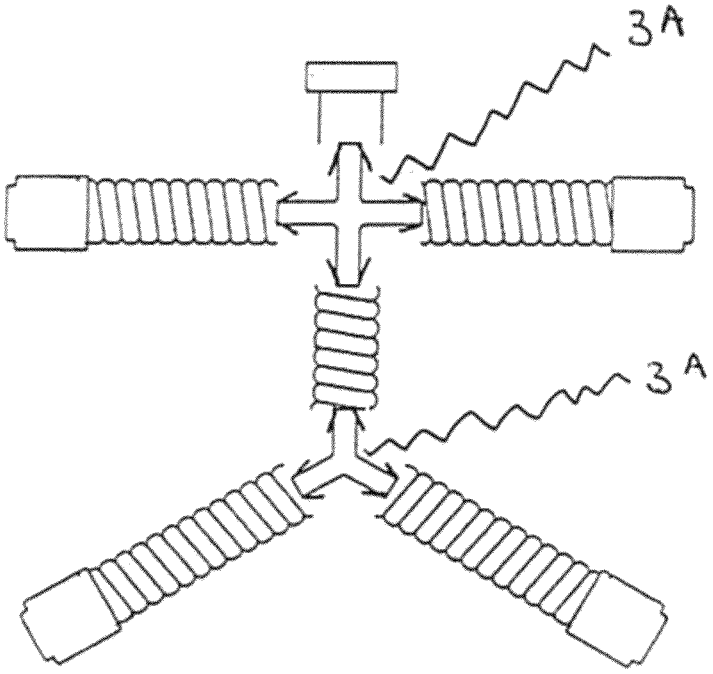
FIGS. 4A and 4B are illustrations showing connectors used in a magnetic stretch toy figure according to another exemplary embodiment of the present invention.
Figure 4B:
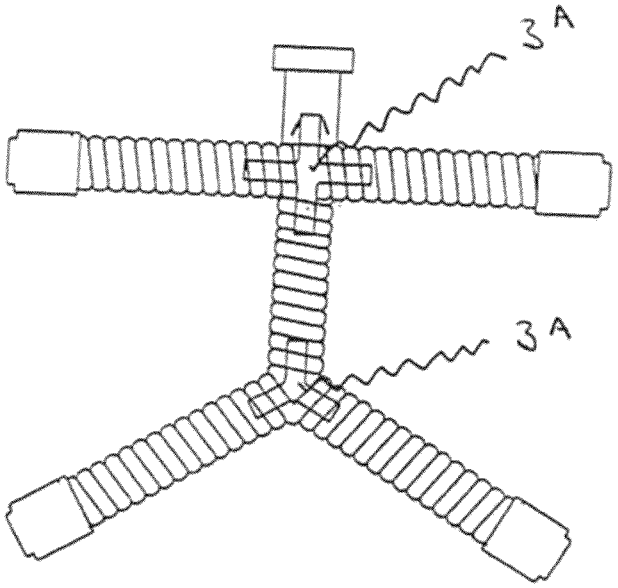

FIGS. 4A and 4B show an alternate design for connectors that reverses the female and male orientation so that connector 3A becomes a male member to the body part 2. As in the previous embodiment, adhesive may be used to secure the connector 3A with the body parts 2.

The magnetic stretch toy FIG. 1 may be used in a board game. For example, the stretch toy FIG. 1 may be used as avatars that correspond to each one of multiple players in a game. In a particular example, a combination of a three dimensional game board, two magnetic toy figures of differing colors and a chance spinner may be used to play a game of twist. Thus, rather than requiring the actual players to twist on a floor mat, the magnetic toy FIG. 1 may be used as avatars and positioned on a three dimensional metal game board according to the outcome of the chance spinner.

In a board game according to an exemplary embodiment of the present invention, differently colored positions are arranged on the board at differing heights and a separate spinner is used by the players to determine the positioning of the avatar figure. Unlike the original game of twist where hands and feet, left and right are indicated on the spinner device, the game of twist according to the present invention may involve only movement of appendages, arm or leg, with no left/right requirement. The magnetic figure can be placed on the colored positions indicated on the flat plain or on the vertical side edges of the game board, which makes the game unique and interesting.

According to an exemplary embodiment of the present invention, the rules of the game of twist may require each player to operate the spinner and, depending on where the spinner arrow lands, place the arm or leg of the corresponding avatar on one of the colored positions, or connect a leg to any arm or arm to any leg. Play may continue until the magnetic toy figure avatars of all players are entangled and either fall out of position or a particular task designated by the spinner cannot be completed. The remaining player may be designated the winner.

The game may include one or more of the following rules: if all same colored positions are taken, next avatar landing on that color loses game; any position can be taken on the vertical side edges; if a player dislodges an opponent's avatar when placing their own avatar, that player loses the game; three attempts are allowed to fix an avatar in place, so that after a third failed attempt that player loses.

Figure 5A:
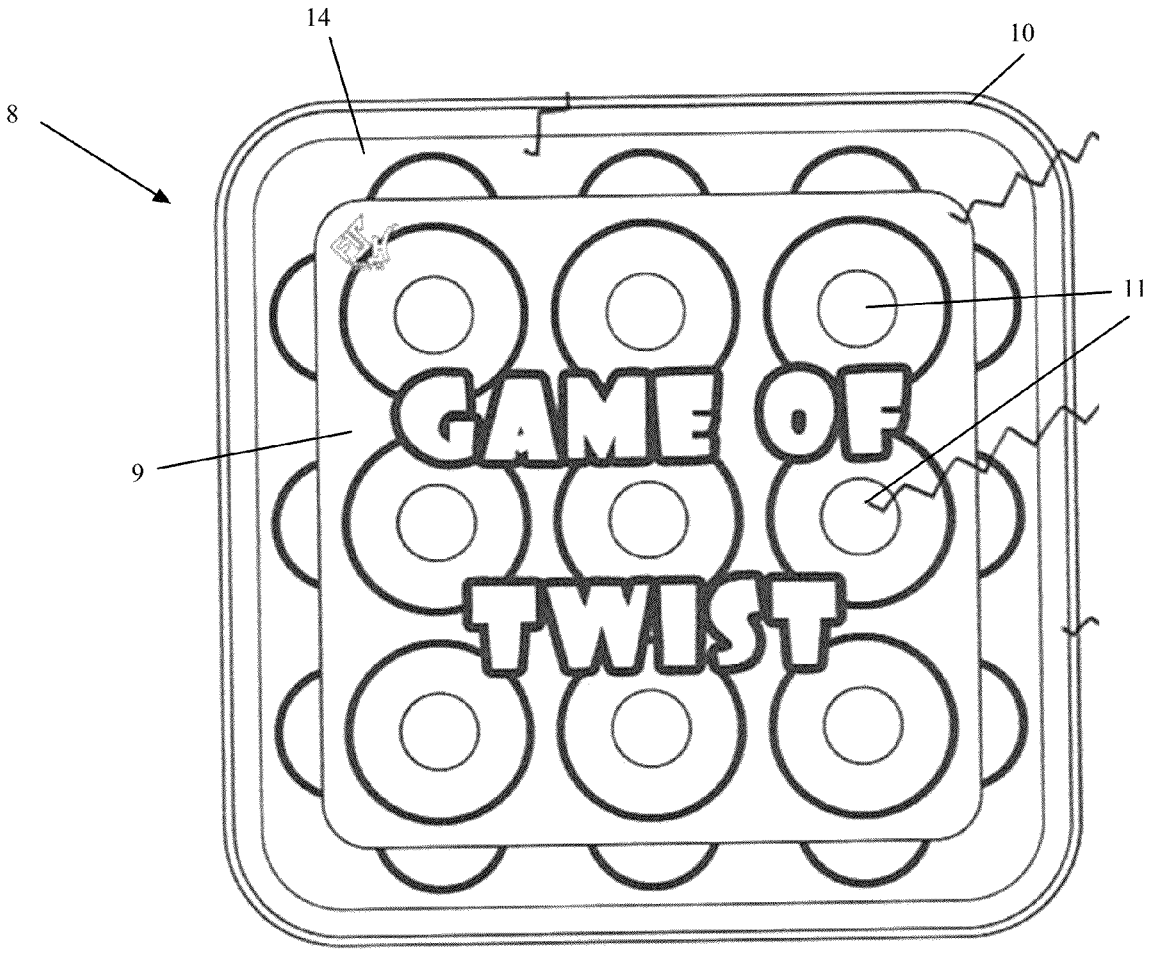
FIGS. 5A and 5B show elements of a board game according to an exemplary embodiment of the present invention.

FIG. 5A shows a game board, generally designated by reference number 8, according to an exemplary embodiment of the present invention. The game board 8 includes a flat base 14, a primary game board 9, and vertical side edges 10 extending upwards from the game board 8. The flat base 14 and vertical side edges 10 are preferably made of metal. The primary game board 9 may be disposed in an elevated position relative to the flat base 14 and include a number of colored positions through which holes 11 extend to expose the flat base 14 positioned below the primary game board 9. The primary game board 9 may be made of any suitable material, such as, for example, a foam material. During game play, appendages of the magnetic toy figure avatars may be extended through the holes in the primary game board 9 and into magnetic contact with the underlying flat base 14 so that the avatars may be positioned in various orientations.

Figure 5B:
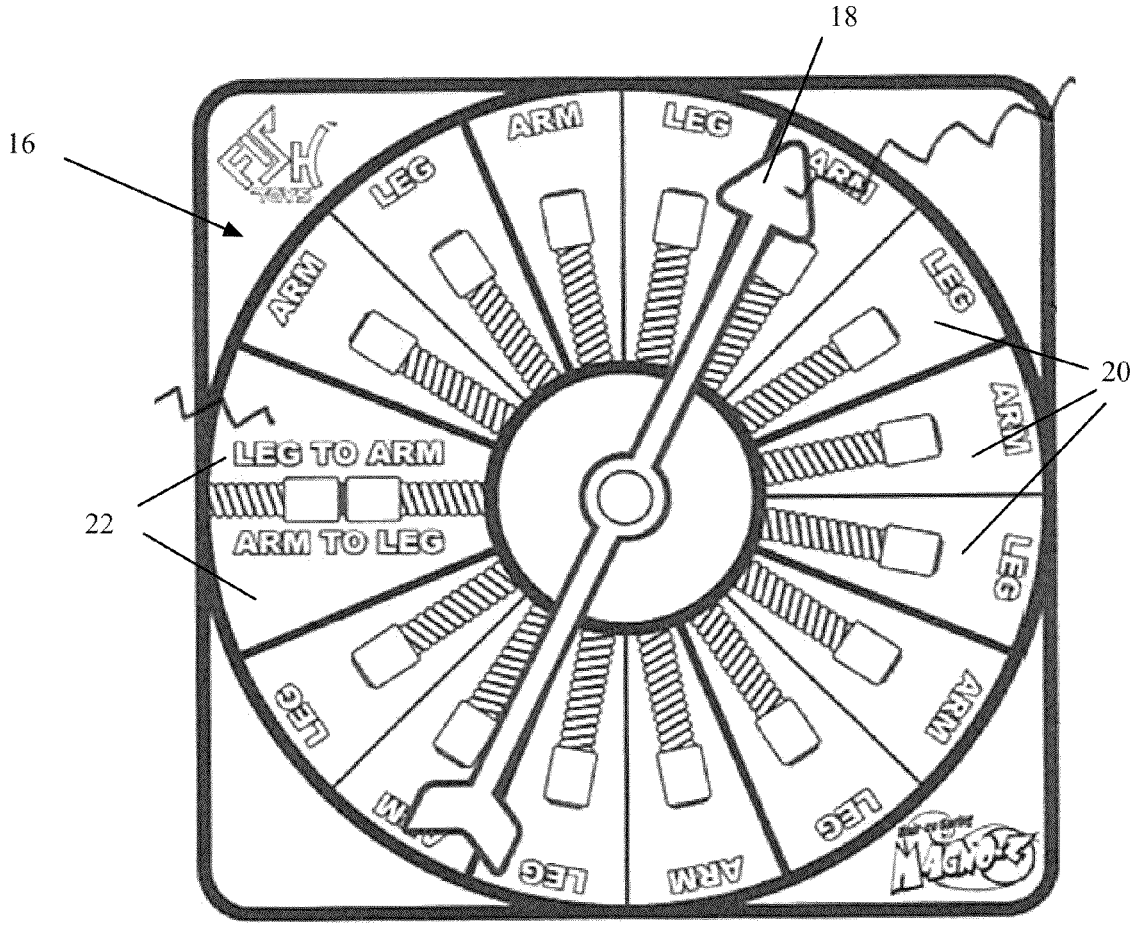

FIG. 5B shows a spinner, generally designed by reference number 16, useable with a board game according to an exemplary embodiment of the present invention. The spinner 16 includes an arrow 18 that can be spun to indicate which appendage of the magnetic toy figure avatar is to be used when placing the avatar on the game board 8, and where the appendages are to be located. In this regard, the spinner 16 may be separated into differently colored segments 20, with each segment 20 colored differently to correspond with a colored location on the game board 8. For example, a segment

20 may be colored red and labeled "leg", so that if the arrow 18 lands on that segment 20 the player would be required to position a leg of his magnetic toy avatar on a red position on the game board 8. A specific color may be designated to indicate that the appendage should be attached to the vertical side edge 10 of the game board 8. Other segments 22 of the spinner 16 may be designated to indicate whether a leg should be attached to an any arm or vice versa.

Figure 6:
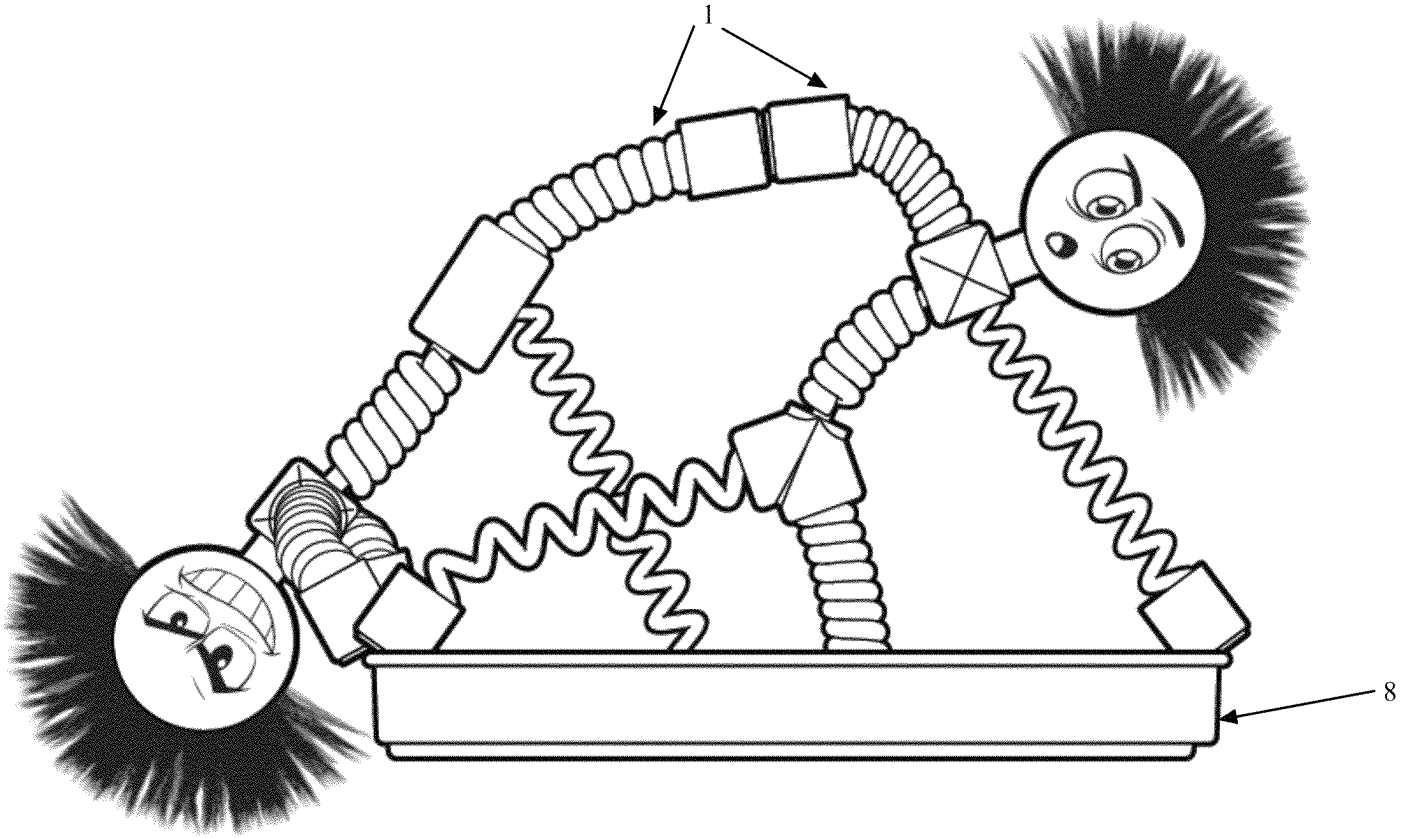
FIG. 6 shows magnetic stretch toys positioned on a game board during a board game according to an exemplary embodiment of the present invention.

FIG. 6 is a side elevational view of the game board 8, on which are positioned two magnetic toy figure avatars.

Now that embodiments of the present invention have been shown and described in detail, various modifications and improvements thereon will become readily apparent to those skilled in the art. Accordingly, the spirit and scope of the present invention is to be construed broadly not limited by the foregoing specification.

What is claimed is:

1. A game assembly comprising:

a game board having distinguishable spaces thereon, wherein each of said distinguishable spaces contains a magnetic metal;

a plurality of toy figures, wherein each of said plurality of toy figures has appendages made from non-magnetic plastic springs that terminate with an end portion, wherein each end portion contains a magnet that enables each said end portion of each of said appendages to both magnetically connect to said plurality of distinguishable spaces on said game board, and to magnetically connect to each other; and a spinner for randomly selecting from a plurality of segments, wherein at least some of said segments identify both one of said appendages for each of said plurality of toy figures and at least one of said distinguishable spaces on the game board.

2. The assembly according to claim 1, further including at least one segment from among said plurality of segments that identifies two of said appendages.

3. The assembly according to claim 1, wherein said game board includes a base that is magnetic and a surface elevated above said base that is non-magnetic, wherein said surface contains holes through which said end portion of one of said appendages can pass to magnetically connect to said base.

4. The assembly according to claim 3, wherein said surface is supported above said base by vertical side edges, wherein said vertical side edges are magnetic.

5. The assembly according to claim 1, further including at least one segment from among said plurality of segments on said spinner that identifies said vertical side edges.

* * * * *